US005956926A

United States Patent [19]

O'Connor et al.

[11] Patent Number: 5,956,926

[45] Date of Patent: Sep. 28, 1999

[54] PACKAGING A STRIP OF MATERIAL BY FOLDING AND CUTTING THE FOLDED PACKAGE

[75] Inventors: Lawrence J. O'Connor; Mark B. Davidson; Darrell Van Mol, all of Winnipeg, Canada

[73] Assignees: KT Holdings, Inc., Winnipeg, Canada; Stac-Pac Technologies, Inc., Christchurch, Barbados

[21] Appl. No.: 08/939,815

[22] Filed: Sep. 29, 1997

Related U.S. Application Data

[63] Continuation-in-part of application No. 08/878,826, Jun. 19, 1997, and application No. 08/889,737, Jul. 8, 1997.

[51] Int. Cl.[6] ..... B65B 63/04; B65B 31/00; B65B 61/06

[52] U.S. Cl. ..... 53/429; 53/434; 53/435; 206/494; 206/524.8; 493/415; 493/357; 493/363

[58] Field of Search ..... 53/429, 116, 117, 53/434, 435, 513, 520, 157; 206/494, 524.8; 493/413, 414, 415, 410, 411, 437, 448, 439, 440, 357, 356, 363

[56] References Cited

U.S. PATENT DOCUMENTS

| | | | |
|---|---|---|---|
| 32,761 | 7/1861 | Elliot . | |
| 1,463,918 | 8/1923 | Borroughs . | |
| 1,985,676 | 12/1934 | Hand . | |
| 3,245,680 | 4/1966 | Harrison et al. | 493/413 |
| 3,351,992 | 11/1967 | Carter | 53/429 |
| 3,673,757 | 7/1972 | Willis | 53/429 |
| 3,684,275 | 8/1972 | Schweitzer et al. | 493/413 X |
| 3,729,367 | 4/1973 | Shore et al. | 53/429 |
| 3,739,544 | 6/1973 | Hanemann . | |
| 4,097,039 | 6/1978 | Fischer | 493/413 |
| 4,201,029 | 5/1980 | Lerner et al. | 53/429 |
| 4,240,854 | 12/1980 | Massey et al. | 53/429 X |
| 4,418,514 | 12/1983 | Spann | 53/434 X |
| 4,427,404 | 1/1984 | Yamada . | |
| 4,499,707 | 2/1985 | Desjobert et al. . | |
| 4,547,184 | 10/1985 | Bunch, Jr. . | |
| 4,597,748 | 7/1986 | Wolf . | |
| 4,603,817 | 8/1986 | O'Connor . | |
| 4,716,706 | 1/1988 | Boeckmann . | |
| 4,896,475 | 1/1990 | McAvinew | 53/117 |
| 4,941,374 | 7/1990 | Focke | 53/157 X |
| 5,036,977 | 8/1991 | Schofield et al. . | |
| 5,064,179 | 11/1991 | Martin . | |
| 5,087,140 | 2/1992 | Keeton et al. . | |
| 5,104,366 | 4/1992 | Bunch | 493/414 X |
| 5,177,934 | 1/1993 | Yamamoto | 53/434 X |
| 5,290,226 | 3/1994 | Green, Jr. . | |
| 5,529,564 | 6/1996 | Hediger . | |

FOREIGN PATENT DOCUMENTS

| | | | |
|---|---|---|---|
| B-22983/83 | 3/1986 | Australia . | |
| 383501 | 8/1990 | European Pat. Off. . | |
| 47638 | 3/1982 | Japan | 53/116 |
| 2-182666 | 7/1990 | Japan . | |
| 1555205 | 4/1990 | U.S.S.R. | 53/429 |

*Primary Examiner*—Linda Johnson
*Attorney, Agent, or Firm*—Oliff & Berridge, PLC; Adrian D. Battison

[57] ABSTRACT

A package of a continuous strip of material includes a plurality of parallel side by side stacks each containing a length of the strip which is folded back and forth such that each folded portion of the stack is folded relative to the next portion about a line transverse to the strip and such that the side edges of the strip portions are aligned. The strip is continuous through each stack and is connected by a splice from the end of one stack to beginning of the next stack. The package can be compressed to reduce the height of the stacks and maintained in the compressed condition by an evacuated sealed bag. The package can be formed by folding a wide web of material back and forth and by slicing the folded web in a direction parallel to the sides of the web to form one or more stacks of a strip of width less than that of the web. The stack can be used to form the above package or can be used in a further processing by unfolding slitting and winding.

17 Claims, 9 Drawing Sheets

PACKAGING A STRIP OF MATERIAL BY FOLDING AND CUTTING THE FOLDED PACKAGE

This application is a continuation in part application of copending application Ser. No. 08/878,826 filed Jun. 19th, 1997, and of a second application Ser. No. 08/889,737 filed Jul. 8th 1997. Further details are disclosed in application Ser. No. 08/906,291 filed Aug. 5th, 1997 and now abandoned, in two further application Ser. Nos. 08/939,444 and 08/939,881 filed simultaneously with this application. The disclosures of the above applications are incorporated herein by reference.

This invention relates to a package of a continuous strip of material and to a method for forming a package of a continuous strip of material.

BACKGROUND OF THE INVENTION

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

The purpose of the festooning method is for packaging the strip for supply to a machine using the strip. Some users prefer the festooned package relative to a wound package of this type of material. The festooned package contains a much greater length of material than a spirally wound pad. The festooned package can simply be located adjacent the machine without the necessity for any unwinding or support stand. In addition, both the leading end and the tail end of the package are available at the top of the package so that a series of the packages can be connected lead to tail to act as an extended supply. Yet further, since the material is simply laid into the package, there is less problem with tension control in the material as it is withdrawn from the package, in comparison with larger traverse wound packages where tension control of large packages can be a problem due to the inertia of the package thus requiring a driven unwind stand as well as material handling equipment for moving the large rolls. There is therefore no need when festooned packages are used for a complex unwind stand which takes up more space than may be available and involves significant cost.

Festooned packages are formed in a stiff container or box to properly enclose and contain the material and within which the material is stored during transportation for maintaining the material against compression and distortion due to the transfer of loads from surrounding packages. The cardboard container thus provides support for other similar stacked containers and prevents the transfer of loads from the stacked packages from causing excessive compression of packages at the bottom of a layer. The cardboard containers and the package structures used in the conventional arrangement however have a number of problems.

Firstly the container must be either recycled with the necessity of shipping the cardboard containers in the return direction to the supplier from the end user or they must be discarded, both at considerable expense.

Secondly the cardboard containers simply receive the material without significant compression so that there is wastage of space within the container due to the packaging of air with the material. In addition the conventional package structure does not minimize the amount of air spaces formed in the structure. The transportation costs of the material therefore are significantly increased by the large volume of the material which provides a density which is significantly below the optimum for most efficient transport.

Thirdly the presence of the essential box during formation of the structure provides a restriction to the proper control of the strip as it is laid down since the sides of the box provide limitations to the position and movement of the guide member controlling the strip.

Fourthly it has been noted that the sides of the box which are parallel to the strips as they are laid down do not closely confine the sides of the package structure with the significant danger that the strips can fall down between the edge of the package and the box side.

In addition, the conventional technique for forming the package in which each of the strips slit from a web of supply material is individually packaged at a separate festooning station is slow and requires a large amount of floor space for the large number of stations. Also the large area covered by the stations causes a significant distance to be traveled by the strip from the slitting station to the festooning station with the potential for strip tension problems and damage to the strip.

There remains therefore a significant requirement for a package of this general type but the techniques presently available are unsatisfactory for the above reasons leaving opportunity for an improved package structure.

In this application, the term "strip" is not intended to imply any particular width of the strip. In some embodiments, the strip can be relatively narrow being formed by slitting from a wider web. In other embodiments, the term "strip" is applied to a full width web or blanket which is not slit.

SUMMARY OF THE INVENTION

It is one object of the present invention, therefore, to provide an improved method of handling a strip or web by which rolling and unrolling of wide width webs can be avoided.

According to one aspect of the invention there is provided a method of forming at least one package of a strip of sheet material comprising:

providing a strip of the sheet material from a supply thereof, the strip having a first surface, a second surface, a first side edge and a second side edge;

forming the strip into a body having two opposed first sides, two opposed second sides and two opposed ends by repeatedly folding the strip back and forth to form a plurality of folded portions of the strip, with each portion of the strip being folded relative to one next portion about a first fold line transverse to the strip and relative to a second next adjacent portion about a second fold line transverse to the strip and spaced from the first line such that:

the portions thus form a plurality of first fold lines arranged at one of the first sides of the body and a plurality of second fold lines arranged at the other of the first sides;

the portions have the side edges thereof generally parallel to the second sides and lying directly on top of and aligned with a previous portion;

the strip is traversed across the body from one of the first sides to the other of the first sides; and the strip has the first and second surfaces thereof generally parallel to the ends of the body;

and cutting through the body, along a cut line from one first side to the opposed first side and from one end to the opposed end, so as to divide the body into separate portions, the cut line extending in a direction generally parallel to the second sides.

In accordance with a particularly preferred method according to the present invention there is provided a method of forming at least one package of a strip of sheet material comprising:

providing a strip of the sheet material from a supply thereof, the strip having a first surface, a second surface, a first side edge and a second side edge;

forming the strip into a body having two opposed first sides, two opposed second sides and two opposed ends by repeatedly folding the strip back and forth to form a plurality of folded portions of the strip, with each portion of the strip being folded relative to one next portion about a first fold line transverse to the strip and relative to a second next adjacent portion about a second fold line transverse to the strip and spaced from the first line such that:

the portions thus form a plurality of first fold lines arranged at one of the first sides of the body and a plurality of second fold lines arranged at the other of the first sides;

the strip is traversed across the body from one of the first sides to the other of the first sides; and the strip has the first and second surfaces thereof generally parallel to the ends of the body; and the portions have the side edges thereof generally parallel to the second sides and lying directly on top of and aligned with a previous portion;

and cutting through the body, so as to divide the body into separate portions, in a plurality of parallel planes substantially parallel to the second sides, the parallel planes being spaced across the body to define between each plane and the next a respective one of a plurality of separate layers each formed from a separate strip portion of the sheet material.

Preferably the strip of each layer is continuous though each layer from a first end portion of the strip at one end of the layer to a second end portion of the strip at an opposed end of the layer, such that a full extent of the strip from the first end portion to the second end portion can be unfolded from the layer by pulling the strip from either end portion.

Preferably at least some of the layers are collated into a package of the layers in parallel side by side arrangement to define first and second end layers of the package and a plurality of intermediate layers.

Preferably an end of the strip of each layer is connected to an end of the strip of the next adjacent layer with one end of the strip of the first end layer forming a leading end strip of the package for supply to an end use machine and one end of the strip of the second end layer forming a trailing end strip of the package for connection to a further package such that the strip is continuous through the package and such that a full extent of the strip from said leading end layer to said trailing end can be unfolded for supply to said end use machine.

Preferably the package is arranged such that the first end portions of the layers are arranged at one end of the package and the second end portions of the layers are arranged at an opposed end of the package and wherein the first end portion of the strip of each intermediate layer is connected to the first end portion of the strip of the first next adjacent layer and the second end portion of the strip of each intermediate layer is connected to the second end portion of the second next adjacent layer.

Preferably the first end portion of the strip of each intermediate layer is connected to the first end portion of the strip of the first next adjacent layer by a traverse portion extending diagonally between the layers and the second end portion of the strip of each intermediate layer being connected to the second end portion of the second next adjacent layer by a traverse portion extending diagonally between the layers.

Preferably the first end portion of the strip of each intermediate layer is connected to the first end portion of the strip of the first next adjacent layer by splicing and the second end portion of the strip of each intermediate layer being connected to the second end portion of the second next adjacent layer by splicing.

Preferably the ends of the layers are mechanically compressed to apply compression in a direction at right angles to the ends such that the layers are in a compressed condition in a direction at right angles to the surfaces of the portions to reduce a length of the package between the ends and providing a wrapping around the compressed package to maintain the package in the compressed condition by pressure of atmospheric air on the packaging material.

Preferably the packaging material is sealable and including the steps of wrapping the package prior to the compression thereof; after the compression of the wrapped package, applying a vacuum to the packaging material to remove the air therefrom; and sealing the packaging material such that the package is maintained compressed by pressure from the sealed packaging material.

Preferably the flexible packaging material holds the layers together in a direction at right angles to the planes containing the side edges of the portions by pressure from the packaging material.

Preferably the package is wrapped by the flexible packaging material so as to be free from rigid side supports.

Preferably the packaging material is dimensioned such that the packaging material expands in a direction at right angles to the ends of the package when the vacuum is released to release the pressure on the strip.

According to a third aspect of the invention there is provided a method of using a strip of sheet material comprising:

providing a strip of the sheet material from a supply thereof, the strip having a first surface, a second surface, a first side edge and a second side edge;

forming the strip into a body having two opposed first sides, two opposed second sides and two opposed ends by repeatedly folding the strip back and forth to form a plurality of folded portions of the strip, with each portion of the strip being folded relative to one next portion about a first fold line transverse to the strip and relative to a second next adjacent portion about a second fold line transverse to the strip and spaced from the first line such that:

the portions thus form a plurality of first fold lines arranged at one of the first sides of the body and a plurality of second fold lines arranged at the other of the first sides;

the strip has the side edges thereof generally parallel to the second sides and the strip being traversed across the body from one of the second sides to the other of the second sides; and the portions have the side edges thereof generally parallel to the second sides and lying directly on top of and aligned with a previous portion;

cutting through the body, so as to divide the body into separate portions, in a plane substantially parallel to the second sides;

taking one of the portions which has thus been cut to length and withdrawing the strip portion therefrom;

and slitting the strip portion longitudinally at a plurality of transversely spaced locations on the strip portion to form a plurality of narrower strips side by side.

Preferably the strip is supplied directly from a manufacturing line such that the strip is folded to form said package body at an end of the manufacturing line without any intervening winding of the trip into a roll of the strip.

Preferably the narrower strips are formed into individual packages by winding of the narrower strip around a core to form a cylindrical package.

BRIEF DESCRIPTION OF THE DRAWINGS

One embodiment of the invention will now be described in conjunction with the accompanying drawings in which.

DETAILED DESCRIPTION

As shown in FIGS. 1 to 4, a package comprises a generally rectangular package or body 10 formed from a strip or sheet 11 of a pliable material to be packaged and generally this material will be of a fibrous nature formed by woven or non-woven material although this is not essential to the package structure. Many materials of various thicknesses can be packaged using the festooning technique provided they can accept the creasing necessary at the end of each portion.

Figure 2:
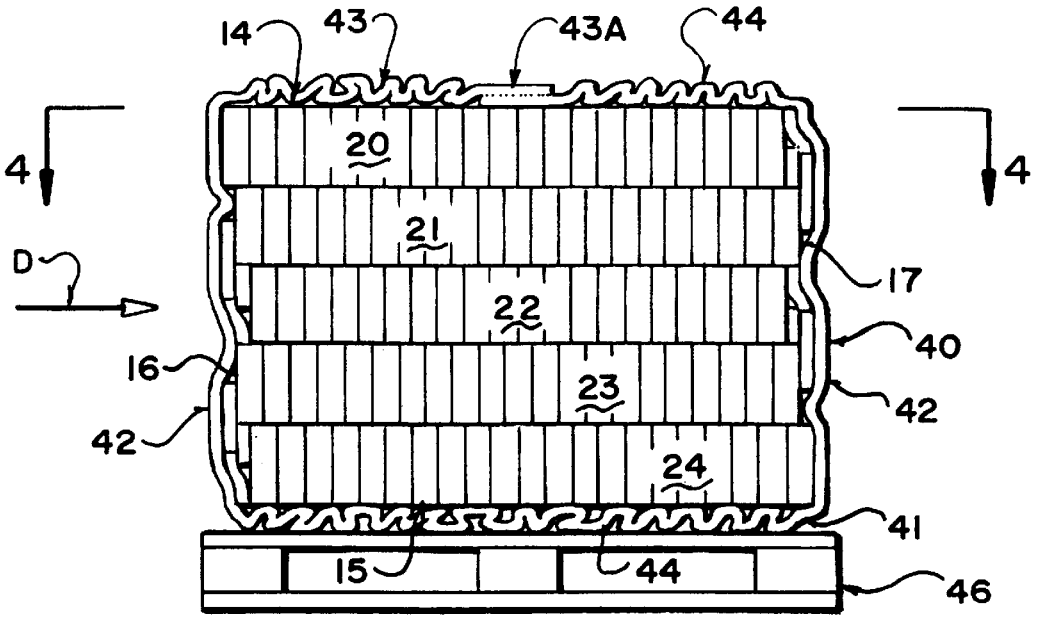
FIG. 2 is a cross sectional view along the lines 2—2 of FIG. 1, with the flexible packaging material and an optional pallet included and the package rotated to its normal transportation position with the layers horizontal.
Figure 3:
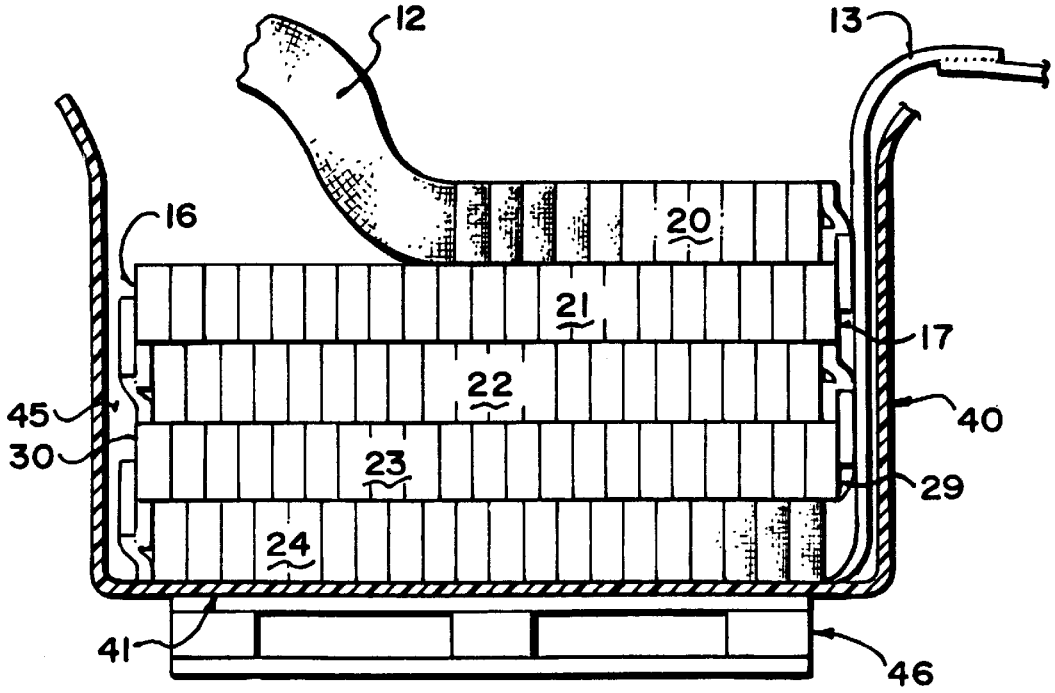
FIG. 3 is a cross sectional view similar to that of FIG. 2 showing the package opened and the strip partly withdrawn.
Figure 4:
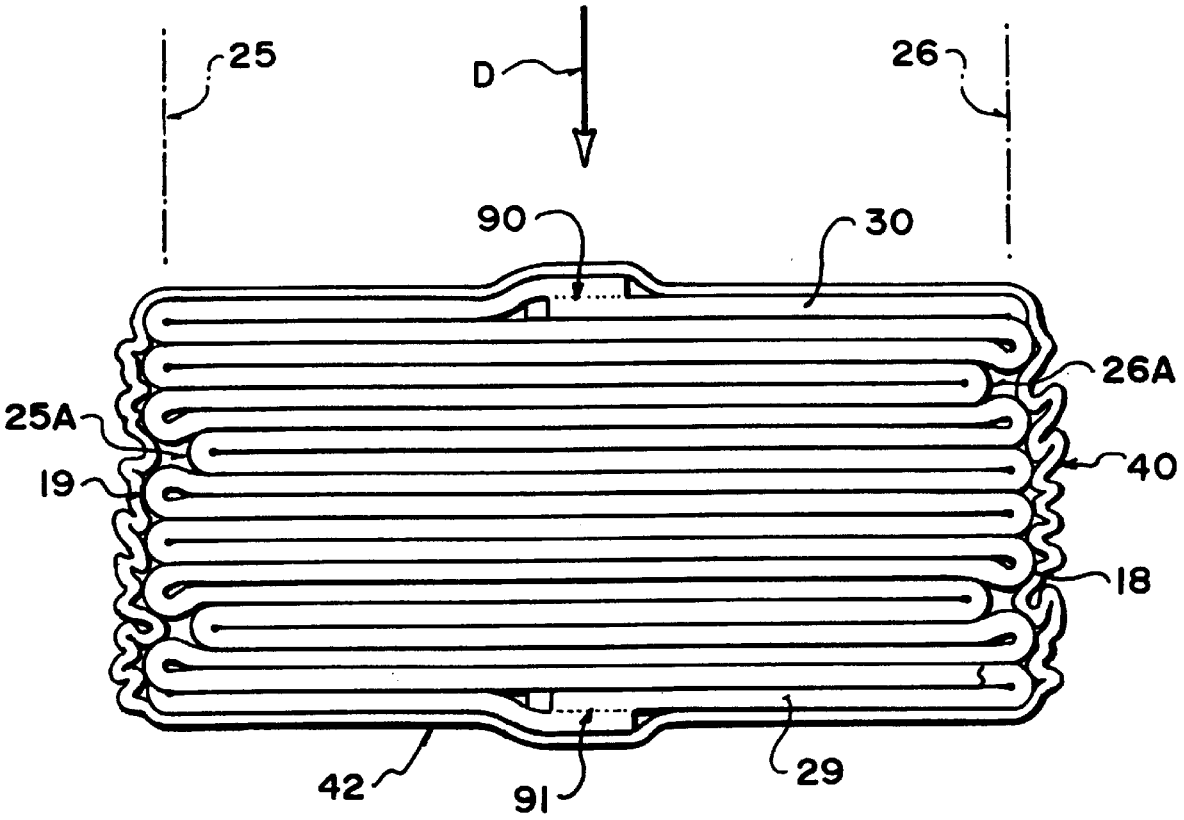
FIG. 4 is a cross sectional view along the lines 4—4 of FIG. 2.

The strip has a leading end 12 and a trailing end 13 of the package and otherwise is substantially continuous through the package. The package when oriented in its normal position for transportation or use as shown in FIGS. 2, 3 and 4 has a top 14, a bottom 15, two sides 16 and 17 and two ends 18 and 19.

The package is formed by a plurality of layers of strips also referred to herein as stacks. In the embodiments shown in FIGS. 1 to 4, there are five layers of the strip indicated respectively at 20, 21, 22, 23 and 24. The layers are parallel and an outer side of the layer 20 forms the top surface 14 of the package and an outer side of the layer 24 forms the bottom surface 15 of the package. The package thus has end layers 20 and 24 and a plurality (in this embodiment three) of intermediate layers.

Figure 9:
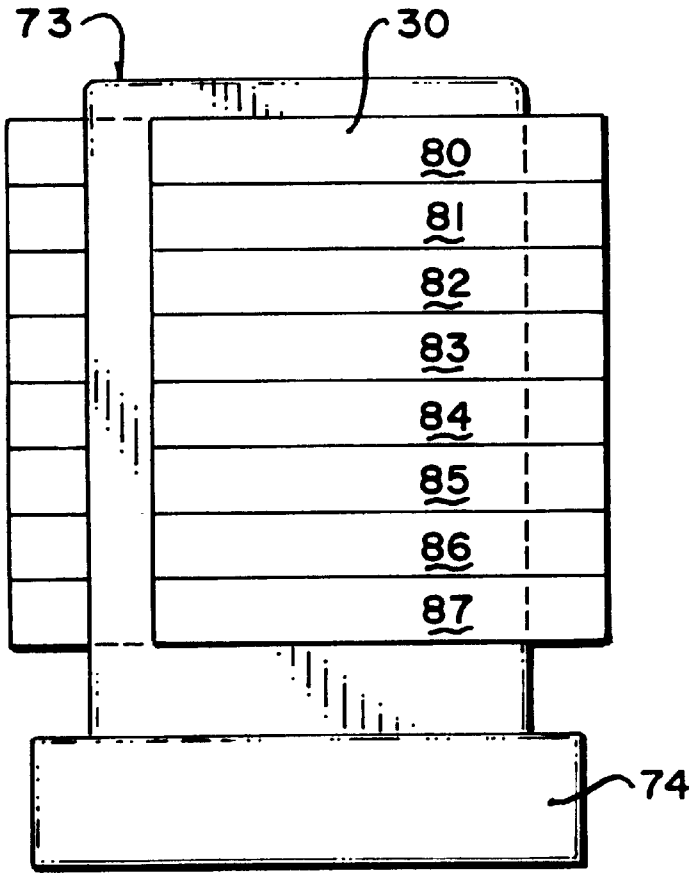
FIG. 9 is a top plan view of the structure of FIG. 8.
Figure 11:
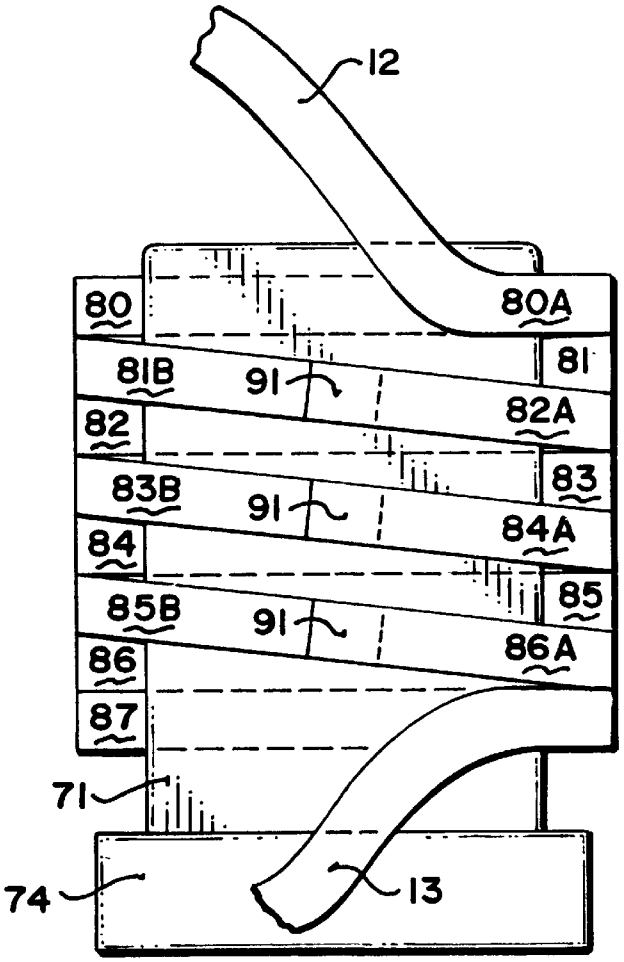
FIG. 11 is a bottom plan view of the structure of FIGS. 8 and 9 after completion of the splices in the strip between the layers and showing the free ends of the strip at the end layers of the package.
Figure 10:
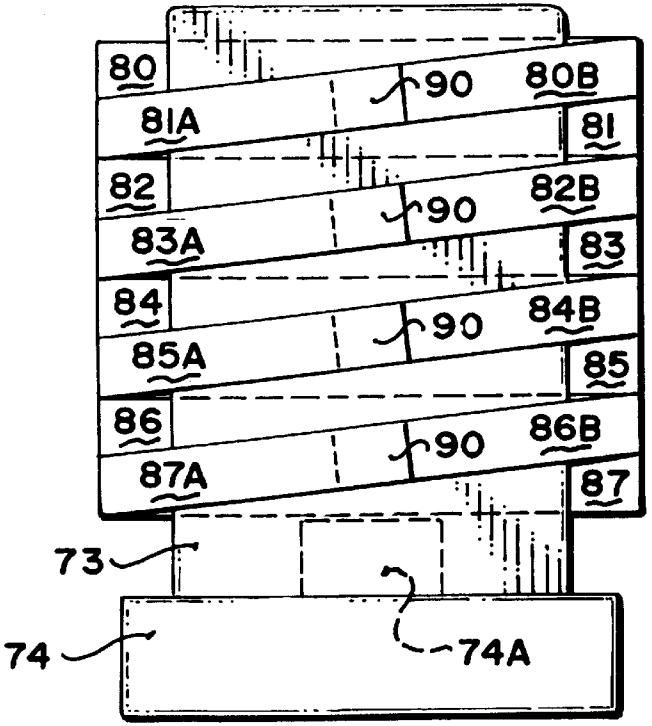
FIG. 10 is a view as shown in FIG. 9 after completion of the splices in the strip between the layers.

It will be appreciated that the dimensions of the package can of course be varied in accordance with the requirement so that the number of layers, the length of each layer and the height of each layer can be varied and in FIGS. 9 to 11, the package is shown as having eight layers.

Figure 1:
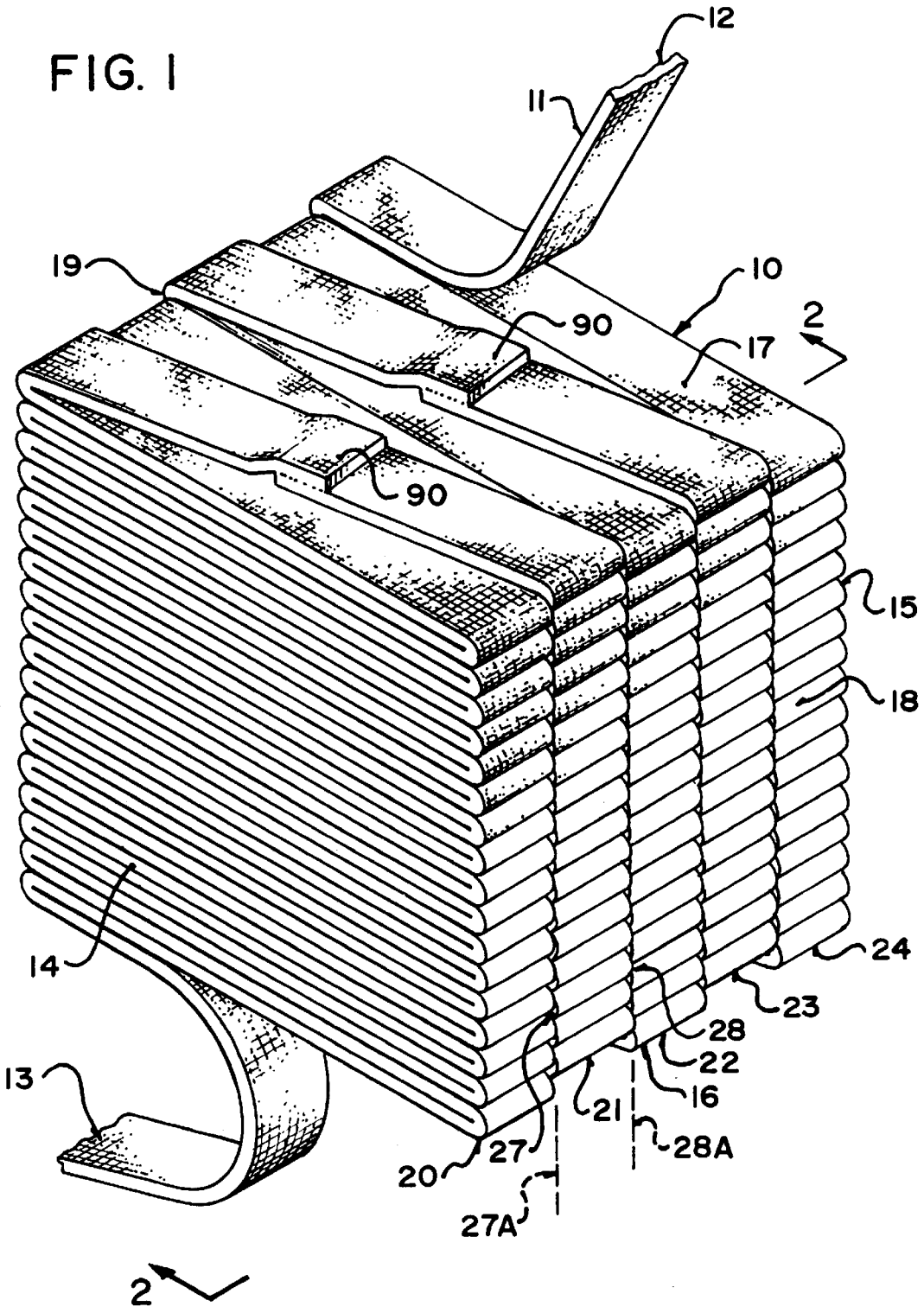
FIG. 1 is a schematic isometric view of a package of a continuous strip according to the present invention, the package including five layers of the strip and being shown with the flexible packaging material omitted for convenience of illustration.

Each layer of the strip comprises a plurality of portions of the strip which are laid on top of one another. Thus as shown in FIG. 4 the portions are folded back and forth at respective end fold lines 25 and 26 to form accordion folds so that the fold lines lie in a common vertical plane defining the ends 18 and 19 of the package. Each portion of the strip lies directly on top of the previous portion so that side edges 27 and 28 of the portions of strip lie in common vertical planes 27A, 28A as shown in FIG. 1.

Thus the package is formed by laying the portions each on top of the next from a bottom portion 29 up to a top portion 30 to form the layer. The package is thus formed from the plurality of layers each of which has a length equal to that of the other layers and therefore equal to that of the package and the layers are formed up to a common height which is therefore equal to the height of the package.

The package is wrapped by a flexible packaging material preferably of heat sealable non-permeable plastics which encompasses the whole of the package as indicated at 40. The packaging material includes a base 41 and sides 42 with a top 43 wrapped over the top of the package and heat sealed as indicated at 43A. The sealed package allows air to be extracted from the package and this vacuum action can be used with physical compression from the sides 16 and 17 of the package so as to compress the package to a reduced height in a vacuum packaging system. The amount of compression can be determined so as to minimize the volume of the package without interfering with the required loft of the product when withdrawn from the package. In this way the package structure avoids the necessity for rigid sides of a box or similar container so the package structure is stable due to the compression of the layers to reduce the height of the layers and due to the pressure of each layer against the sides of the next adjacent layers.

Compression of the package is only possible in the direction D which is at right angles to the surfaces of the portions of the strip. This acts to compress the thickness of the portions so that the dimension of each layer in the direction D is reduced by that compression. Compression along the portions or at right angles to the layers is not possible since this will act to distort the strip. Mechanical compression therefore of the package in the direction D thus reduces the dimension of the package in that direction allowing the air to be withdrawn from the flexible packaging material 40 causing the packaging material to be pulled down onto the package to maintain it in its compressed condition and to apply pressures tending to hold the layers in intimate contact.

In the rest condition of the packaging material as shown in FIG. 3, the base 41 of the packaging material 40 is shaped and dimensioned so as to be slightly larger than the rest or uncompressed condition of the package structure itself. In this way the package structure can be readily inserted into the formed plastics packaging material and can remain in place loosely held by the packaging material. During transportation and storage the package structure is in the compressed and vacuumed condition. In this condition the base 41 of the packaging material and the top 43 of the packaging material are both compressed in the direction D so as to form wrinkles or creases 44. When the vacuum is released, however, the expansion of the package from its compressed condition to its normal relaxed condition will cause the creases 44 to be extracted as shown in FIG. 3. Also, in the expanded condition of FIG. 3, there is a slight space 45 between the sides 42 of the packaging material and the sides 16 and 17 of the package structure allowing the strip to be pulled in the unwrapping process from the ends of the layers without compressing or distorting the end portions 29 and 30.

When wrapped, compressed, sealed and mounted on a transportation pallet 46, the package structure is oriented so that the layers are horizontal. In this orientation, the application of vertical loads onto the package from other packages causes the transfer through the package structure to the pallet 46 without distorting or damaging the strip. This occurs due to the fact that the strip is relatively stiff across its width and when compressed into the layers, the strips together form a substantially rigid structure.

This orientation of the package used for unwinding the package is shown in FIG. 3. Thus in FIG. 3 a partial unwinding of the structure is shown in that the top 43 is opened and the leading end 12 of the strip is found and pulled through the opening. By placing the package in this orientation, therefore, each layer in turn can be unwound without the danger of the layer toppling since it is lying on its side supported by the underlying layers.

Each layer is connected to the next by a traverse portion of the strip which extends from one layer to the next. Thus the intermediate layers are each connected so that one end of the strip of that layer is connected to the next adjacent layer on one side and the other end of the strip of that layer is connected to the next adjacent layer on the opposite side. A technique for connecting the strip of each layer to the next layer is shown and described in more detail hereinafter.

As shown in FIG. 4, some of the transverse fold lines can be offset from all or some of the others in a direction longitudinal of the portions. Thus the fold lines 25A are offset inwardly from the plane 25 at one end and the fold lines 26A are similarly offset from the plane 26. This technique can be used to prevent build-up at the ends of the package when the material being packaged is resistant to folding leaving a fold of increased height.

Figure 5:
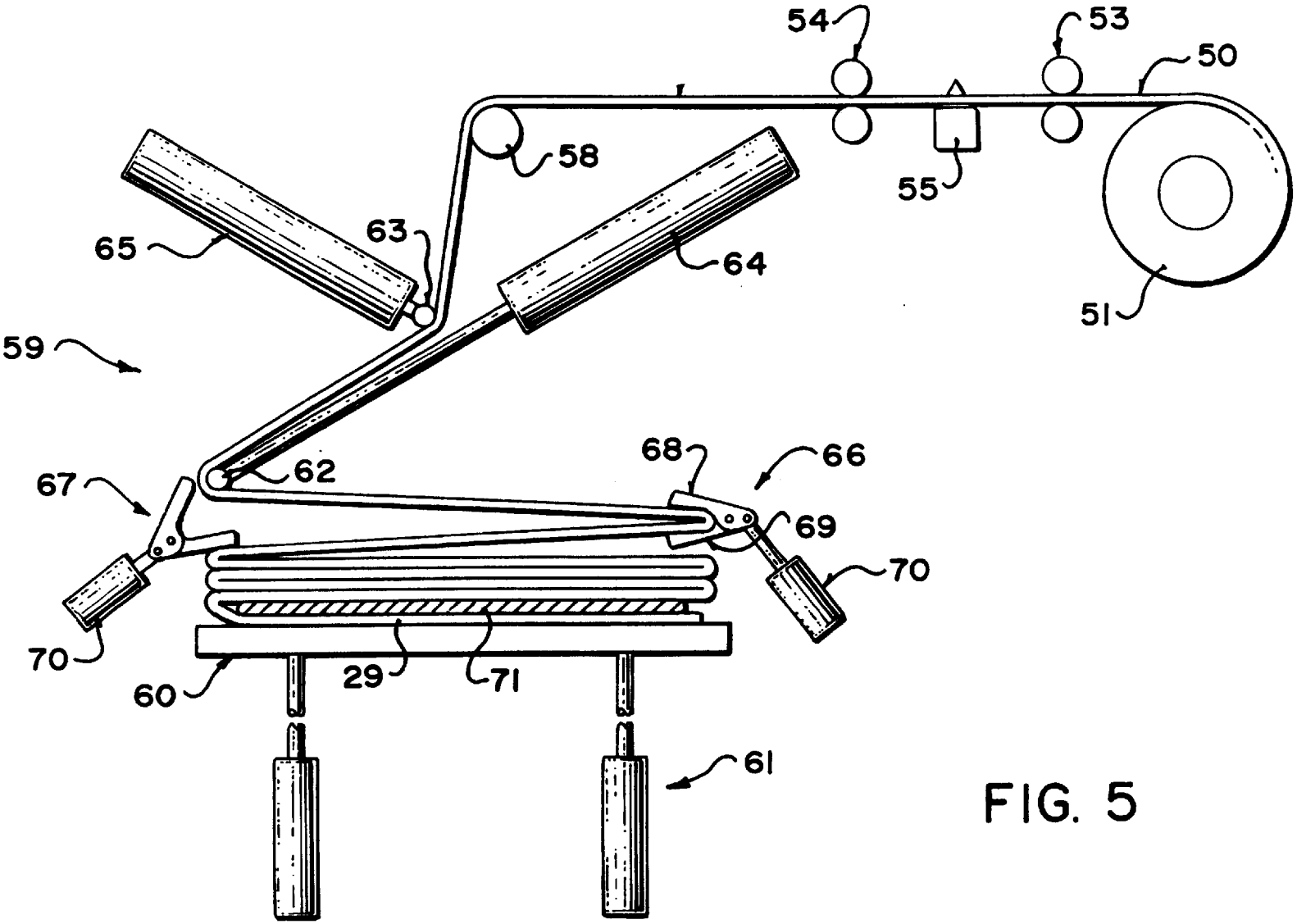
FIG. 5 is an end elevational view of an apparatus and method for use in forming a folded intermediate structure to be used in manufacturing the package of FIG. 1.
Figure 6:
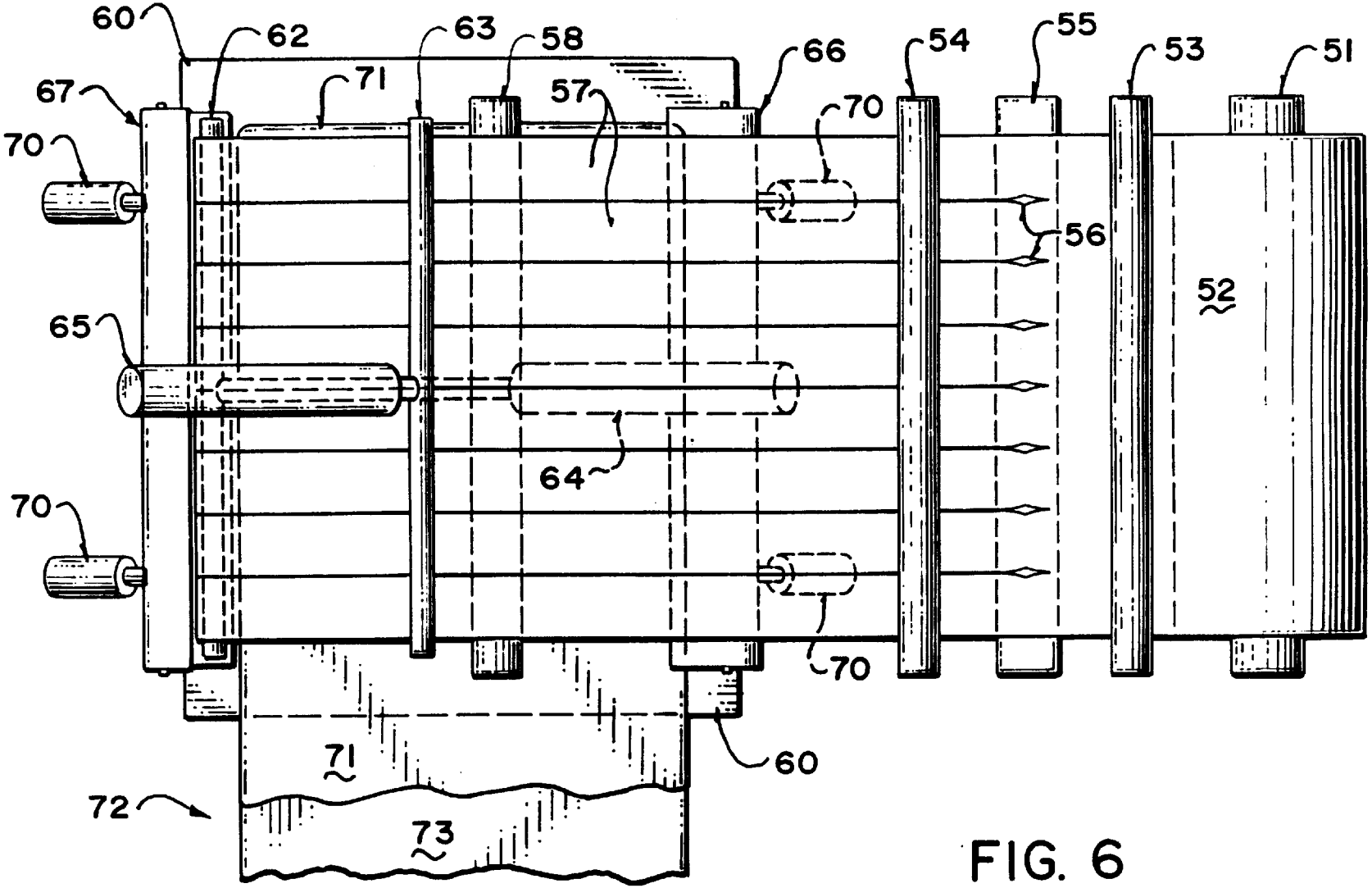
FIG. 6 is a top plan view of the apparatus of FIG. 5.

Turning now to FIGS. 5 and 6, a technique for forming the package structure is shown in more detail. A web 50 is supplied on a master roll 51 and is unwound from the master roll by a feeding and guide system 52 including two nip roller pairs 53 and 54. The coplanar web 57 is fed over a guide roller 58 into a folding system generally indicated at 59 located underneath the feed roller 58.

The folding system 59 comprises a support table 60 having a width sufficient to receive the full width of the web 50, that is the strips in side by side arrangement. The support table 60 has a length sufficient to receive the portions of the folded strips in the structure as previously described. The table 60 is mounted upon a jacking system 61 which is shown only schematically and acts to raise and lower the table so that the table is gradually lowered as the strips are folded onto the table.

The folding system further includes a pair of folding bars 62 and 63 which act to fold the strips back and forth across the table 60. The folding bar 62 is mounted on an actuating cylinder 64 and similarly the folding bar 63 is mounted on an actuating cylinder 65. In FIG. 5, the folding bar 63 is shown in the retracted position and the folding bar 62 is shown in the extended position. The folding bars move alternately between these positions so that the folding bar 62 is firstly retracted and then the folding bar 63 is extended so as to move the web across the table to form the overlying portions of the strip previously described. The folding bars 62 and 63 extend across the full width of the web so as to move the web into the folded positions. The folding bars 62 and 63 may be in the form of rollers to allow the material to pass over the bar without friction while the material is being pushed by the bar to the required position on the table. The mounting system for supporting the cylinders is not shown for convenience of illustration and this will of course be well apparent to one skilled in the art.

The folding system further includes a pair of creasing jaws 66 and 67 each arranged at the end of the stroke of a respective one of the folding bars. The creasing jaws also extend across the full width of the web and comprise a pair of jaw elements 68 and 69 which can be moved from an open position as indicated on the left and a closed creasing position as indicated on the right. The jaws are moved between these positions by an actuating cylinder 70 timed in relation to the operation of the cylinder 64 and 65. In addition to the opening and closing movement, the creasing jaws also move inwardly and outwardly in a horizontal direction relative to the table so as to release each fold or crease line after it is formed to allow that layer and the fold at the end of the layer to be dropped onto the previous layers and to move downwardly with the table 60. Thus as illustrated, the creasing jaw 66 at the completion of the crease moves outwardly away from the crease or fold line and at the same time opens slightly to release the fold between the two portions to drop downwardly onto the underlying portions. The jaws then open and move back inwardly ready to receive the portion of the web wrapped around the folding bar and to grasp those as they are released from the folding bar as shown at the creasing jaw 67 in FIG. 5. This compound motion can be effected by suitable mechanical linkage operated by the actuating cylinder 70, this arrangement again being well apparent to one skilled in this art.

The web is therefore simultaneously laid down in portions folded back and forth on top of one another. In order to provide a continuous web, one or more master rolls may be spliced into the supply with the splice being formed across the width of the web.

Figure 7:
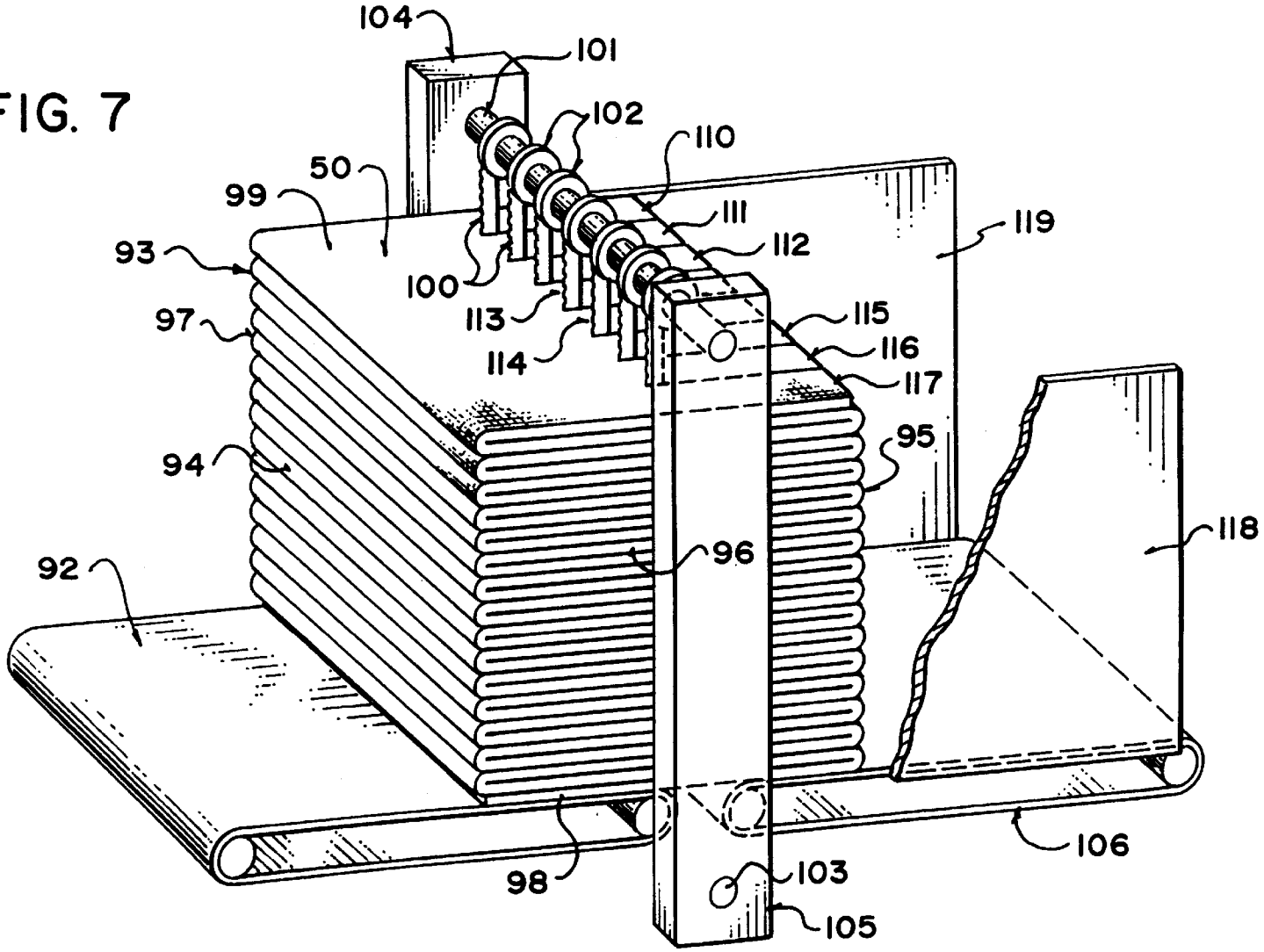
FIG. 7 is an isometric view of an apparatus for cutting the folded intermediate structure manufactured in the method of FIG. 5 for forming the package of FIGS. 1 to 4.

Turning now to FIG. 7, the body formed by the folded web is then transferred from the table 60 onto a belt conveyor 92. The body 93 has the web 50 folded back and forth as shown so as to form on the body ends 94 and 95 containing the fold lines of the web together with sides 96 and 97 which contain the overlying side edges of the portions of the web. A lowermost web portion 98 is at the bottom of the body and an uppermost web portion 99 is at the top of the body.

A cutting assembly for the body comprises a plurality of band saw blades 100 arranged at spaced positions along a shaft 101. The band saw blades 100 are each mounted on a respective one of a plurality of pulleys 102 so that rotation of the shaft drives the band saw blade along its length. The band saw blades 100 are arranged to stand vertically in parallel vertical planes parallel to the sides 96 and 97 of the body. Each band saw blade 100 has an idler pulley mounted on a shaft 103 underneath the body and at the discharge end of the conveyor 92. The shafts 103 and 101 are mounted on two parallel support towers 104 and 105 at respective sides of the body. A second conveyor 106 is arranged with an upper run lying in a common horizontal plane with the upper run of the conveyor 92 so as to carry the body through the cutting assembly from an initial uncut position on top of the conveyor 92 to a second position on top of a conveyor 106 in which the body has been cut by the band saw blades 100 to separate the body into a plurality of parallel layers 110 through 117 which are in effect of the same construction as the layers 80 through 87 of the arrangement shown in FIGS. 9, 10 and 11. Two side guide walls 118 and 119 are provided for engaging the sides 96 and 97 of the body after cutting to maintain the integrity of the body as it is carried through the cutting station and after cutting is complete while the body is standing on the conveyor 106.

The band saw is of a type known as a razor knife band which is intended to effect a cutting action without removing material from the body as the cutting occurs. The razor knife band is of a type having a scalloped front edge chamfered on both sides of the front edge. The fact that the material can be slightly distorted allows the band blade to slide through the material without removing material from the body. The blade is arranged so that it can accommodate the significant length between the shafts 101 and 103 without significantly distorting from the straight line therebetween. An increased width of the blade may therefore be necessary in view of the relatively long length of the blade to provide a cutting action of up to four feet of the height of the body.

The individual layers for a package structure of this type can therefore be formed in different ways and can be assembled into a package structure.

The technique using the cutting action through the body is particularly effective in that it ensures that the layers are entirely separate without any interleaving and allows the folding action to be effected more rapidly.

As shown in FIGS. 8, 9, 10 and 11, a bottom clamping plate 71 of a clamping system is generally indicated at 72. The clamping system comprises the bottom plate 71 and a top plate 73. The clamping plates are movable by an actuation system schematically indicated at 74. The clamping plates 71 and 73 are parallel and initially horizontal so that they can be inserted between the portions of the strips across the full width of the web.

The actuation system 74 provides complex movement of the clamping plates. Thus the clamping plates can be extended and retracted in a longitudinal direction independently of one another. The clamping plates can be moved together to reduce the spacing therebetween while remaining parallel in a clamping action so as to squeeze the portions of the web between the clamping plates. The clamping plates can be rotated about a central horizontal axis through 90° and 180° so as to rotate the package structure to present different surfaces at the top. The clamping plates can be translated from a position on top of the table 60 to a separate location for depositing the package structure onto the pallet 46, if this is used in transportation.

The bottom clamping plate 71 is inserted on top of the lowermost portion 29 so that the lower most portion lies underneath the clamping plate and is therefore exposed when the clamping plate and the package are removed from the table 60. In the formation of the package, therefore, the clamping plate 71 is extended into position on top of the table after the lowermost portion 29 is laid, following which the further portions are laid on top of the clamping plate 71.

Figure 8:
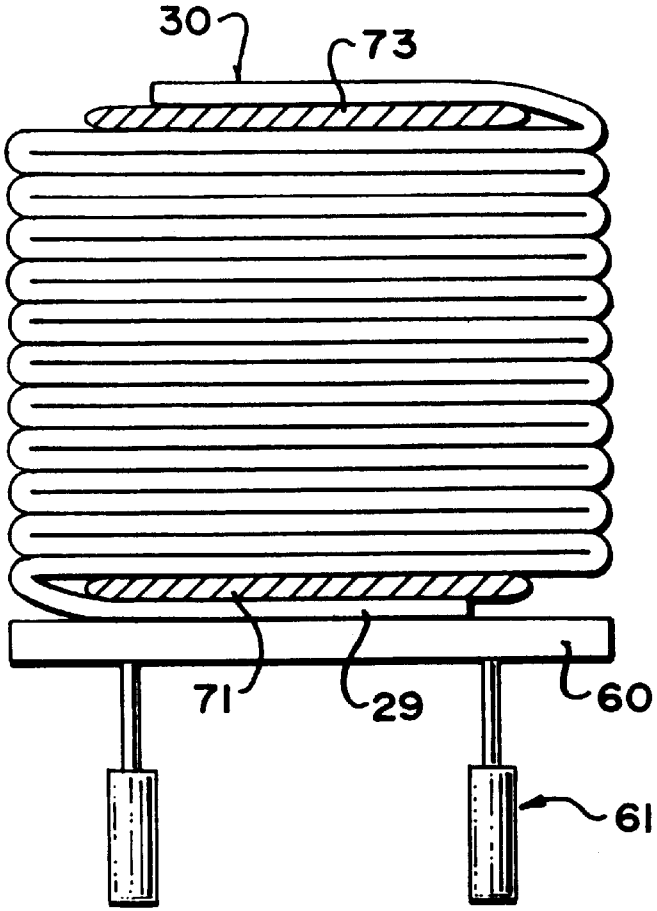
FIG. 8 is a side elevational view of the cut folded structure of FIG. 7 showing top and bottom clamping plates holding the structure for movement to different required orientations.

Symmetrically the top clamping plate 73 is moved into position, as shown in FIG. 8, when the number of portions in the layer is complete and immediately prior to the laying of the last portion 30. Therefore again, the last portion 30 is exposed when the clamping system including the clamping plate 71 and 73 and the package are removed from the table 60.

After the folding action is therefore complete, the clamping action is effected by extension of the top clamping plate 73 and by a clamping movement squeezing the clamping plates together. When this is completed, the package structure can be removed from the table 60 for the further completing actions as described hereinafter and the folding of a further package structure can be recommenced using a second clamping system independent of the first.

It will be appreciated that, in the stage as shown in FIG. 9 in which the package structure has been removed from the table 60 of FIGS. 6 and 8, each of the layers is separate from and independent of the other layers since each is formed by a respective one of the strips sliced from the web 50. Thus in FIG. 9 there are shown eight layers 80 through 87 arranged side by side with the sides edges of the layers in contact as previously described in relation to the package structure shown in FIGS. 1 through 4.

Turning now to FIGS. 10 and 11, the technique for interconnecting the layers is shown. FIG. 10 shows the package structure in the orientation of FIG. 9. FIG. 11 shows the package after it has been inverted or rotated through 180° about the central axis of the clamping system.

Thus it will be noted that one end 80A of the layer 80 forms the leading end 12 of the package. As shown in FIG. 10 a second end 80B of the layer 80 is spliced by a splice 90 to a leading end 81A of the layer 81.

The opposite end 81B of the layer 81 is spliced by a splice 91 to a leading end 82A of the layer 82. As shown in FIG. 10 the trailing end 82B of the layer 82 is spliced to the leading end 83A of the layer 83 by a splice 90.

In a symmetrical manner, as shown in FIG. 10 the trailing end 84B of the layer 84 is spliced to the leading end 85A of the layer 85 by a splice 90. In addition a further splice 90 interconnects the trailing end 86B of layer 86 and the leading end 87A of the layer 87.

As shown in FIG. 11, two further splices 91 are formed between the trailing end 83B of layer 83 and the leading end 84A of the layer 84, and between the trailing end 85B of a layer 85 and the leading end 86A of the layer 86.

The splices 90 are all formed on top of the top clamping plate 73 using the clamping plate as a support base for effecting a strong seal which in some cases may be usable in the end use machine without the necessity for cutting out the splice. Since the splice is formed while the package is stationary, it can be formed using careful technique such as stitching or heat sealing depending upon the materials involved. In this way the splice can be made as effective as possible so as to minimize the inconvenience of a splice in subsequent processing. Various techniques for splicing are available depending upon the type of material to be spliced.

After the package is inverted as shown in FIG. 11, the splices 91 can be formed on top of the bottom plate 71 which is now at the top, again using that plate as a support base.

It will be noted from FIGS. 10 and 11 that the spliced portions extend diagonally from one layer to the next. In order to achieve this arrangement from the construction shown in FIG. 9, it is necessary to pull a part of the strip from underneath the top plate 73 at the layers 81, 83, 85 and 87 and to connect that pulled portion to the exposed portion of the strip at the layers 80, 82, 84 and 86. In most cases this necessitates cutting of an extra exposed piece as waste leaving a direct connection forming the diagonally extending spliced portion, such as that defined by the ends 81A and 80B connected by the splice 90.

After the splices are complete, the package is inserted into the bag 40 supported in a vacuum packing system schematically indicated at 40A. The bag is dimensioned as previously described so that the insertion of the package into the bag can be effected without difficulty. Once inserted into the bag, the clamping plates 71 and 73 are retracted by the actuation system 74 using a push rod 74A to push the package away from the clamping plates so that the package is released from the clamping plates and deposited into the bag 40. When placed into the bag or wrapping material, the vacuum sealing system 40A is operated to complete the compression of the package and the sealing of the vacuum packing material 40 as previously described.

Figure 12:
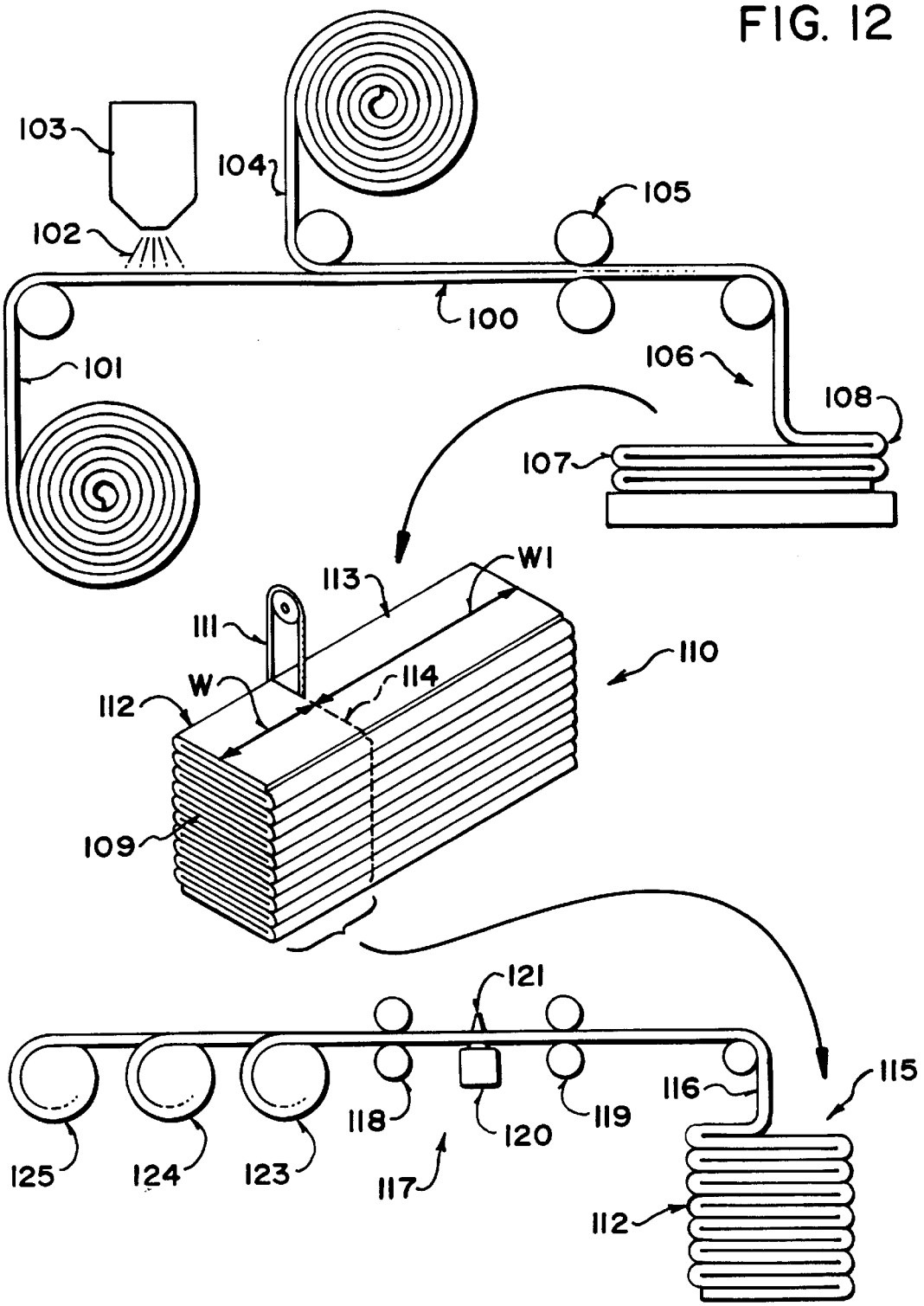
FIG. 12 is a schematic illustration of a method of forming a plurality of packaged strips using the intermediate structure formed by the method of FIGS. 5 and 6.

Turning now to FIG. 12 there is shown a method of manufacturing and using a strip or web of a sheet material for slitting of the web of sheet material into a plurality of separate narrower strips. Many end use machines have as their supply a pad of the strip material which is wound onto a cylindrical core with the edges of the strip directly overlying. Other machines require or can use a longer length of the material and hence in winding the strip is traversed back and forth to form a cylindrical package having a width greater than that of the width of the strip.

Up till now in order to manufacture such rolls, sheet material of this type in a web is conventionally wound onto a master roll which can have a width up to or greater than 4 meters and a diameter up to substantially the maximum which allows the finished roll to be handled.

It is necessary therefore to handle the massive roll in an initial step to unwind the roll and to slit the material longitudinally to form intermediate rolls which are then supplied to a slitting machine for slitting into the specific strip width. This intermediate step of slitting the master roll into a number of intermediate rolls is cumbersome and requires massive handling equipment.

The method shown in FIG. 12 provides an alternative to the slitting and rewinding of a massive master roll.

Manufacture of a sheet material 100 is shown schematically including a bottom layer 101 onto which a coating material 102 is applied from a container 103. A top layer 104 is applied onto the bottom layer 101 and the whole structure is bonded using conventional techniques to form the sheet material 100.

A sheet material is carried through a drive system 105 to a folding system 106 which can be of the construction shown in FIGS. 5 and 6 or can use other folding techniques for example those from various prior art patents as will be selected by one skilled in the art. Yet further proposals are shown in copending applications Ser. Nos. 08/939,444 and 08/939,881 of the present applicant filed simultaneously with this application. The disclosure of these copending applications is incorporated herein by reference.

The folding action occurs to form the structure shown in FIGS. 5, 6 and 8 in which the strip of the sheet material is folded back and forth to form overlying layers. The folded sheets thus form a body or structure having fold lines 107 at one of a pair of first sides, fold lines 108 at the other of the pair of first sides, edges 109 of the strip at one of a pair of second sides and opposite edges of the strip at the other of the pair of second sides.

As indicated generally at 110, the finished body when stacked with sufficient of the folded strip is handled on a system similar to that shown in FIG. 7; but in this case a single cutting blade 111 is used to cut the body into two separate portions 112 and 113 along a plane 114 parallel to the second sides 109. Thus the smaller portion 112 which is cut has a width W which is selected in accordance with requirements to provide a required number of strips of a predetermined width to be slit from the intermediate body.

When cut along the plane 114, the smaller body portion 112 is used as the intermediate structure and is moved to form a supply 115 for a further process for slitting of the intermediate structure into a plurality of separate strips.

The supply 115 thus provides the strip portion 116 which has the width W which is withdrawn and passed through a slitting and drive system generally indicated at 117 including drive rollers 118 and 119 and a slitter bar 120 having a plurality of spaced slitting knives 121. Once the strip portion is slit by the knives 121 into a plurality of separate strips of narrow width, these are wound each into an individual roll as indicated at 123, 124 and 125.

Thus the body including the stacked strip can be cut to provide an intermediate supply stack 112 having a width which is measured to provide the required width for the subsequent processing. It will be appreciated that the cutting action with the knife 111 can be repeated on the wider remaining body portion 113 having a wider width W1 so as to cut the portion 113 into yet further smaller portions for supplying a plurality of subsequent processes.

The cutting action which separates the initial stack body into separate body portions avoids the necessity for the intermediate step of unwrapping the strip, slitting the strip longitudinally and rewrapping or folding the strip into a further package. This also avoids the generation of dust at the slitting knives.

The use of the folded body portion provides a package structure in which the trailing end is available for splicing to the leading end of the next package in a manner in which the splicing can be done while the packages are stationary thus avoiding high speed splicing. Such a splice can thus be done in a more effective manner using better splicing techniques such as sewing which cannot be done at high speed.

The folding process can be arranged to provide sufficiently high speed to directly fold the material as supplied from the manufacturing line as shown at the top of FIG. 12. There is no necessity therefore for any intermediate rolling of the material into a roll which then needs to be handled and then unrolled. The body portions after cutting using the knife 111 can be individually compressed and wrapped with a packaging material for transportation in a compressed condition. Methods for compressing and wrapping the body portions as shown in the above applications, the disclosure of which is incorporated herein by reference.

In the embodiment illustrated, the strips are slit or cut in straight lines so that the side edges of the strips are parallel and are parallel to the second sides of the package structure when completed. The strips also lie immediately adjacent such that the whole of the side edges of the strips are in contact with the strips of the next adjacent layer. However in other embodiments, not shown, the side edges of the strips are not necessarily straight but are cut in curved lines so that the width of the strips varies along the length of the strips. Preferably in this arrangement, the next adjacent strip is arranged to have a wider park at the narrower part of the strip so that the strips are Immediately adjacent with no intervening waste. However such strips are longitudinally offset. Also In this arrangement it will be appreciated that the side edges of the strips do not lie in a common plane even though they lie in aligned arrangement. Each line which is right angles to the surface of the strips and contains the aligned edges of the strips is however parallel to the second ends of the package. In the simultaneous cutting action shown in FIG. 7, the cutting assembly can be traversed side to side as it moves through the package to effect the required changing shape of the side edges of the strips.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A method of forming a package of a strip of sheet material comprising:

providing a strip of the sheet material from a supply thereof, the strip having a first surface, a second surface, a first side edge and a second side edge;

forming the strip into a stack having two opposed first sides, two opposed second sides and two opposed ends by repeatedly folding the strip back and forth to form a plurality of folded strip portions of the strip, with each folded strip portion being folded relative to one next folded strip portion about a first fold line transverse to the strip and relative to a second next adjacent folded strip portion about a second fold line transverse to the strip and spaced from the first line such that, the folded strip portions thus form a plurality of first fold lines arranged at one of the first sides of the stack and a plurality of second fold lines arranged at the other of the first sides;

the folded strip portions of the stack each have the first side edges thereof aligned and the second side edges thereof aligned;

the strip is traversed across the stack from one of the first sides of the stack to the other of the first sides of the stack; and the strip has the first and second surfaces thereof generally parallel to the ends of the stack;

and, after the stack is completed, in a single cutting stroke cutting completely through all the folded strip portions in the stack along a cutting plane which extends from one first side to the opposed first side and from one end to the opposed end, so as to divide the stack into separate portions, the cutting plane extending in a direction generally parallel to the second sides.

2. A method of forming at least one package of a strip of sheet material comprising:

providing a strip of the sheet material from a supply thereof, the strip having a first surface, a second surface, a first side edge and a second side edge;

forming the strip into a stack having two opposed first sides, two opposed second sides and two opposed ends by repeatedly folding the strip back and forth to form a plurality of folded strip portions of the strip, with each folded strip portion being folded relative to one next folded strip portion about a first fold line transverse to the strip and relative to a second next adjacent folded strip portion about a second fold line transverse to the strip and spaced from the first line such that, the portions thus form a plurality of first fold lines arranged at one of the first sides of the stack and a plurality of second fold lines arranged at the other of the first sides;

the folded strip portions have the first side edges thereof aligned and the second side edges thereof aligned;

the strip is traversed across the stack from one of the first sides of the stack to the other of the first sides of the stack; and the strip has the first and second surfaces thereof generally parallel to the ends of the stack;

and, after the stack is completed, cutting a plurality of cutting planes through the stack from one first side to the opposed first side and from one end to the opposed end at spaced positions across the stack so as to divide the stack into a plurality of separate stack portions each having a separate strip therein, the cutting of each cutting plane being arranged so as to effect cutting in a single cutting stroke completely through all the folded strip portions of the stack.

3. The method according to claim 2 wherein said cutting planes are equidistantly spaced across the stack such that the strips are substantially identical.

4. The method according to claim 3 wherein said cutting planes each lie in a respective one of a plurality of planes across the body parallel to the second sides such that the strips have parallel side edges.

5. The method according to claim 2 wherein the strip of each stack portion is continuous through the stack portion from a first end portion of the strip at one end of the stack portion to a second end portion of the strip at an opposed end of the stack portion, such that a full extent of the strip from the first end portion to the second end portion can be unfolded from the stack portion by pulling the strip from either end portion.

6. The method according to claim 2 wherein the method includes forming at least some of the stack portions into a package of the stack portions in parallel side by side arrangement to define first and second end stack portions of the package and a plurality of intermediate stack portions.

7. The method according to claim 6 including splicing an end of the strip of each stack portion to an end of the strip of the next adjacent stack portion with one end of the strip of the first end stack portion forming a leading end strip of the package for supply to an end use machine and one end of the strip of the second end stack portion forming a trailing end strip of the package for connection to a further package such that the strip is continuous though the package and such that a full extent of the strip from said leading end stack portion to said trailing end can be unfolded for supply to said end use machine.

8. The method according to claim 7 wherein the package is arranged such that the first end portions of the stack portions are arranged at a first planar end of the package and the second end portions of the stack portions are arranged at a second planar end of the package and wherein the first end portion of the strip of each intermediate stack portion is spliced to the first end portion of the strip of the first next adjacent stack portion by a first splice portion coplanar with the first end and the second end portion of the strip of each stack portion is connected to the second end portion of the second next adjacent stack portion by a second splice portion coplanar with the second end.

9. The method according to claim 6 including engaging the ends of the stack portions with mechanical compression members arranged to apply compression in a direction at right angles to the ends such that the stack portions are in a compressed condition in a direction at right angles to the surfaces of the portions to reduce a length of the package between the ends and wrapping a flexible packaging material around the compressed package to maintain the package in the compressed condition by pressure from the packaging material.

10. The method according to claim 9 wherein the packaging material is sealable and including the steps of wrapping the package prior to the compression thereof; and, after the compression of the wrapped package, extracting air therefrom and sealing the packaging material such that the package is maintained compressed by external pressure of atmospheric air on the sealed packaging material.

11. The method according to claim 9 wherein the flexible packaging material holds the stack portions together in a direction at right angles to the planes containing the side edges of the stack portions by pressure from the packaging material.

12. The method according to claim 11 wherein the package is wrapped by the flexible packaging material so as to be free from rigid side supports.

13. The method according to claim 9 wherein the flexible packaging material is dimensioned such that the flexible packaging material can expand in a direction at right angles to the ends of the package when the pressure on the strip is released.

14. A method of using a strip of sheet material comprising:

providing a strip of the sheet material from a supply thereof, the strip having a first surface, a second surface, a first side edge and a second side edge;

forming the strip into a stack having two opposed first sides, two opposed second sides and two opposed ends by repeatedly folding the strip back and forth to form a plurality of folded strip portions of the strip, with each folded strip portion being folded relative to one next folded strip portion about a first fold line transverse to the strip and relative to a second next adjacent folded strip portion about a second fold line transverse to the strip and spaced from the first line such that, the folded strip portions thus form a plurality of first fold lines arranged at one of the first sides of the stack and a plurality of second fold lines arranged at the other of the first sides;

the folded strip portions of the stack each have the first side edges thereof aligned and the second side edges thereof aligned;

the strip is traversed across the stack from one of the first sides of the stack to the other of the first sides of the stack; and the strip has the first and second surfaces thereof generally parallel to the ends of the stack;

cutting through the stack along a cutting plane from one first side to the opposed first side and from one end to the opposed end, so as to divide the stack into separate stack portions each containing a strip portion, the cutting plane extending in a direction generally parallel to the second sides;

taking one of the stack portions and withdrawing the strip portion therefrom;

and slitting the strip portion longitudinally at a plurality of transversely spaced locations on the strip portion to form a plurality of narrower strips side by side.

15. The method according to claim 14 wherein the strip is supplied directly from a manufacturing line such that the strip is folded to form said stack at an end of the manufacturing line without any intervening rolling of the strip.

16. The method according to claim 14 wherein the narrower strips are formed into individual packages thereof.

17. The method according to claim 14 wherein the narrower strips are formed into individual cylindrical packages by winding of the respective narrower strip around an axis.

* * * * *

UNITED STATES PATENT AND TRADEMARK OFFICE

CERTIFICATE OF CORRECTION

PATENT NO. : 5,956,926

DATED : September 28, 1999

INVENTOR(S) : Lawrence J. O'CONNOR et al.

It is certified that error appears in the above-identified patent and that said Letters Patent is hereby corrected as shown below:

On the title page: Item [73], delete "KT Holdings, Inc., Winnipeg, Canada;".

Signed and Sealed this

Twenty-fifth Day of April, 2000

*Attest:*

Q. TODD DICKINSON

*Attesting Officer*

*Director of Patents and Trademarks*